US010041336B2

(12) United States Patent
Boutte

(10) Patent No.: US 10,041,336 B2
(45) Date of Patent: Aug. 7, 2018

(54) CRIMPED NOZZLE FOR ALTERNATE PATH WELL SCREEN

(71) Applicant: HALLIBURTON ENERGY SERVICES, INC., Houston, TX (US)

(72) Inventor: Blake S. Boutte, Youngsville, LA (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 362 days.

(21) Appl. No.: 14/436,399

(22) PCT Filed: Feb. 8, 2013

(86) PCT No.: PCT/US2013/025298

§ 371 (c)(1),
(2) Date: Apr. 16, 2015

(87) PCT Pub. No.: WO2014/123533

PCT Pub. Date: Aug. 14, 2014

(65) Prior Publication Data

US 2015/0252655 A1 Sep. 10, 2015

(51) Int. Cl.
*E21B 43/08* (2006.01)
*E21B 37/08* (2006.01)

(52) U.S. Cl.
CPC ..... *E21B 43/08* (2013.01); *E21B 37/08* (2013.01); *Y10T 29/49908* (2015.01)

(58) Field of Classification Search
CPC ..... E21B 41/0078; E21B 43/04
See application file for complete search history.

(56) References Cited

U.S. PATENT DOCUMENTS 3,129,777 A * 4/1964 Haspert ..... E21B 10/61 175/340
3,488,468 A * 1/1970 Carbone ..... B23K 9/291 219/136
5,007,684 A * 4/1991 Parrott ..... E21C 35/187 175/424
5,842,516 A * 12/1998 Jones ..... E21B 41/0078 166/222
6,192,999 B1 2/2001 Nguyen
6,491,097 B1 * 12/2002 Oneal ..... E21B 17/1085 166/169
7,373,989 B2 5/2008 Setterberg, Jr.
7,597,141 B2 10/2009 Rouse et al.
7,938,184 B2 5/2011 Yeh et al.
8,151,886 B2 4/2012 Xu et al.

(Continued)

OTHER PUBLICATIONS

"Why does pressure in a nozzle decrease as the fluid velocity increases?", https://www.quora.com/Why-does-pressure-in-a-nozzle-decrease-as-the-fluid-velocity-increases, downloaded Jun. 8, 2017, 5 pages.*

(Continued)

*Primary Examiner* — Jennifer H Gay
(74) *Attorney, Agent, or Firm* — Locke Lord LLP

(57) ABSTRACT

A method of securing a nozzle in an end of a slurry discharge tube can include inserting the nozzle into the end of the slurry discharge tube, and crimping the slurry discharge tube onto the nozzle. A well screen shunt tube assembly can include a slurry discharge tube, and a nozzle inserted into an end of the slurry discharge tube, the slurry discharge tube being crimped onto the nozzle.

9 Claims, 4 Drawing Sheets

(56) References Cited

U.S. PATENT DOCUMENTS

| | | | | |
|---|---|---|---|---|
| 9,097,104 | B2 * | 8/2015 | Royer | E21B 41/0078 |
| 2005/0284643 | A1 * | 12/2005 | Setterberg, Jr. | E21B 41/0078 166/378 |
| 2006/0048942 | A1 | 3/2006 | Moen et al. | |
| 2006/0289413 | A1 * | 12/2006 | Eberle | B23K 9/295 219/137.31 |
| 2007/0062686 | A1 * | 3/2007 | Rouse | E21B 41/0078 166/51 |
| 2008/0314588 | A1 * | 12/2008 | Langlais | E21B 41/0078 166/278 |
| 2013/0284440 | A1 * | 10/2013 | McAfee | E21B 43/114 166/298 |
| 2013/0298351 | A1 * | 11/2013 | Romito | A47L 9/08 15/405 |
| 2014/0238657 | A1 * | 8/2014 | Sladic | E21B 43/04 166/51 |
| 2015/0252655 | A1 * | 9/2015 | Boutte | E21B 37/08 166/222 |

OTHER PUBLICATIONS

"Crimp (joining)", https://en.wikipedia.org/wiki/Crimp_(joining), downloaded Jun. 8, 2017, 5 pages.*

Schlumberger; "Alternate Path Technology", Company brochure TSL-4551, dated May 2001, 8 pages.

International Search Report with Written Opinion dated Oct. 15, 2013 for PCT Patent Application No. PCT/US13/025298, 11 pages.

* cited by examiner

CRIMPED NOZZLE FOR ALTERNATE PATH WELL SCREEN

TECHNICAL FIELD

This disclosure relates generally to equipment utilized and operations performed in conjunction with a subterranean well and, in one example described below, more particularly provides a crimped nozzle for an alternate path well screen.

BACKGROUND

Shunt tubes are sometimes used to provide alternate paths for slurry flow in an annulus between a tubular string (such as, a completion string) and a wellbore. In this manner, the slurry can bypass blockages or restrictions (such as, sand bridging) in the annulus.

However, slurries (such as, proppant or gravel slurries) can be erosive to well screen components. Therefore, it will be appreciated that improvements are continually needed in the arts of constructing and utilizing screens for use in wells.

DETAILED DESCRIPTION

Figure 1:
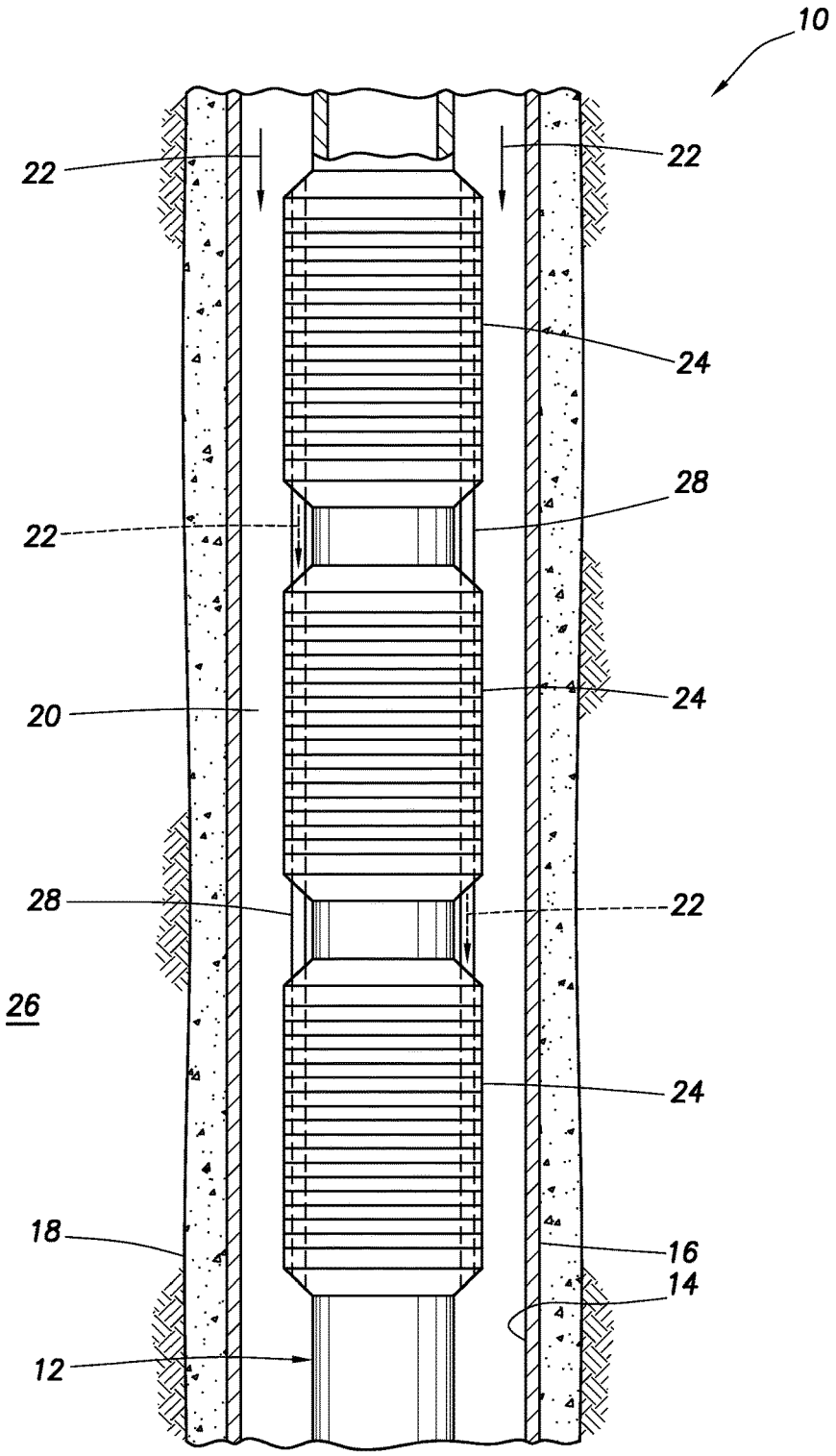
FIG. 1 is a representative partially cross-sectional view of a well system and associated method which can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is positioned in a wellbore 14 lined with casing 16 and cement 18. An annulus 20 is formed radially between the tubular string 12 and the wellbore 14.

In other examples, the wellbore 14 could be uncased or open hole, the wellbore could be generally horizontal or inclined, etc. The annulus 20 is not necessarily concentric, since the tubular string 12 could be to one side or another of the wellbore 14, etc.

It is desired in the FIG. 1 example to fill the annulus 20 with "gravel" about well screens 24 connected in the tubular string 12. For this purpose, a slurry 22 is flowed into the annulus 20, for example, from a surface location.

The slurry 22 in this example is erosive and may comprise a particulate portion (e.g., sand, gravel, proppant, etc.) and a liquid portion. The liquid portion may flow inwardly through the well screens 24 into the tubular string 12, and/or out into a formation 26 surrounding the wellbore 14 (e.g., via perforations, not shown, formed through the casing 16 and cement 18), leaving the particulate portion in the annulus 20 about the well screens 24.

If a fracturing operation is performed, the particulate portion (e.g., proppant, etc.) can flow into fractures formed in the formation 26. Such gravel packing, fracturing, etc., operations are well known to those skilled in the art and so are not described further herein. The scope of this disclosure is not limited to any particular gravel packing or fracturing operation being performed in the wellbore 14.

Part of the slurry 22 is also permitted to flow through shunt tube assemblies 28 extending through the screens 24. The shunt tube assemblies 28 provide multiple alternate paths for the slurry 22 flow, in order to prevent voids in the particulate portion which accumulates about the tubular string 12.

In the FIG. 1 example, each of the shunt tube assemblies 28 provides fluid communication between sections of the annulus 20 on opposite ends of a corresponding screen 24. In addition, as described more fully below, each of the shunt tube assemblies 28 includes nozzles (not visible in FIG. 1) which direct flow of the slurry 22 outward into the annulus 20 along the screen 24, so that a more even distribution of the slurry in the annulus is achieved.

Figure 2:
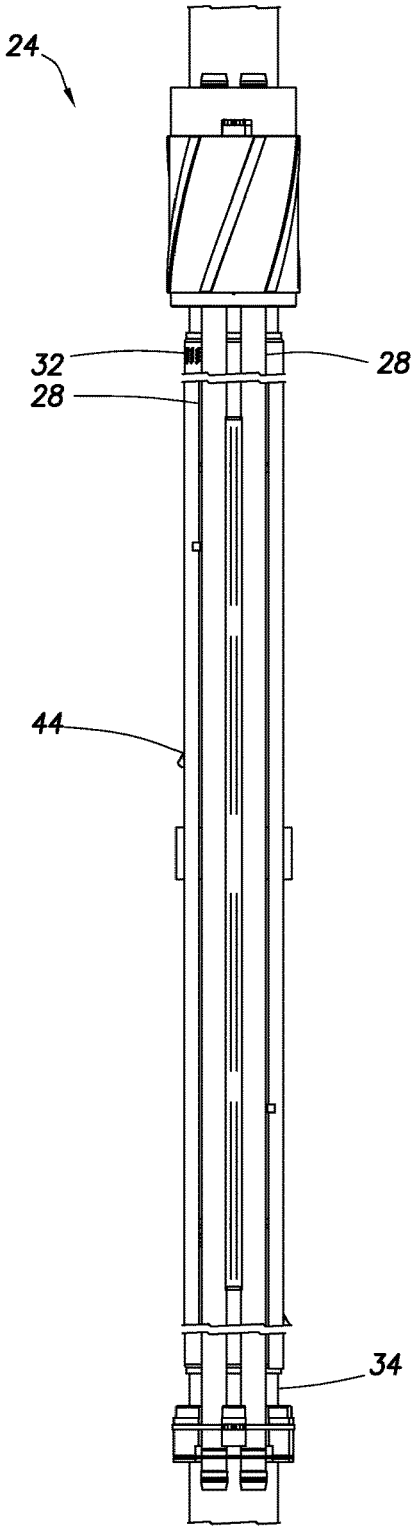
FIGS. 2 & 3 are elevational and partially cross-sectional views of a well screen which may be used in the system and method.
Figure 3:
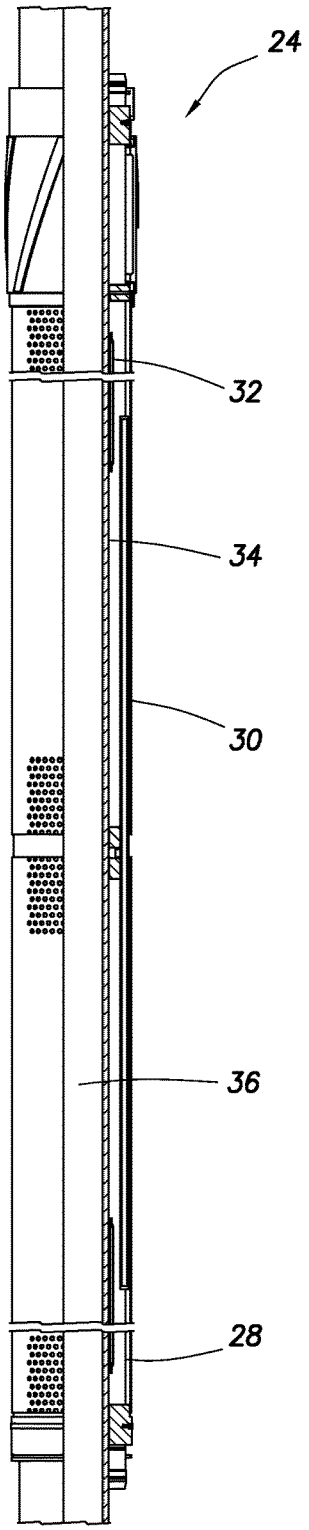

Referring additionally now to FIGS. 2 & 3, an example of a well screen 24 is representatively illustrated in elevational and partially cross-sectional views. The screen 24 may be used in the system 10 and method of FIG. 1, or the screen may be used in other systems and methods.

In FIG. 2, a perforated outer shroud 30 of the screen 24 is removed, so that two shunt tube assemblies 28 are visible. The outer shroud 30 is shown in FIG. 3.

Note that the shunt tube assemblies 28 are positioned in a non-concentric annular space between the outer shroud 30 and a filter 32 which encircles a perforated base pipe 34 of the screen 24. The filter 32 could comprise a mesh, wire wrap, sintered, woven or other type of filter material.

A flow passage 36 which extends longitudinally through the base pipe 34 also extends longitudinally in the tubular string 12 when the screen 24 is used in the system 10 and method of FIG. 1. Thus, the liquid portion of the slurry 22 can flow inwardly through the outer shroud 30, the filter 32 and the base pipe 34, and into the flow passage 36. In other examples, if fracturing of the formation 26 is desired, flow of the liquid portion into the passage 36 may be restricted or prevented, until after the fracturing operation.

Figure 4:
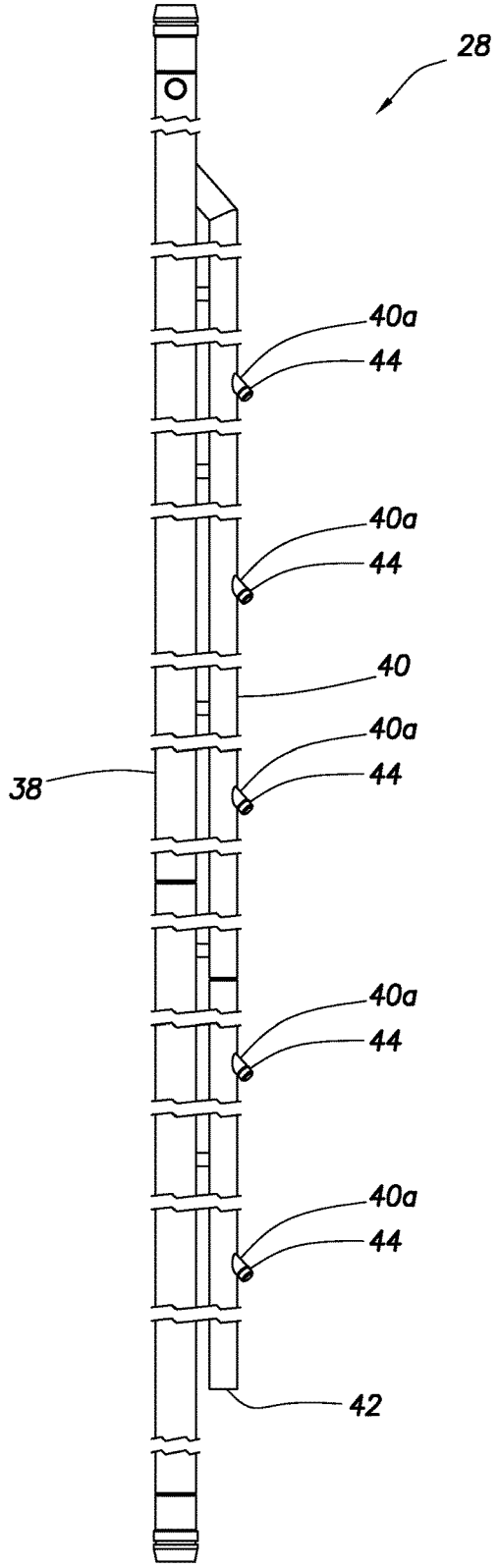
FIG. 4 is an elevational view of a shunt tube assembly which may be used in the well screen.

Referring additionally now to FIG. 4, an example of one of the shunt tube assemblies 28 is representatively illustrated, apart from the screen 24. In this view, it may be seen that the assembly 28 includes generally parallel tubes 38, 40. These tubes 38, 40 are of the type known to those skilled in the art as transport and packing tubes, respectively.

The slurry 22 can flow completely through the tube 38 (e.g., from one screen 24 to another), but a lower end 42 of the tube 40 may be closed off, so that the slurry 22 is directed outward from the tube 40 via nozzles 44. In some examples, the slurry 22 can flow outwardly through the lower end 42 of the tube 40, and through the nozzles 44.

At this point it should be recognized that the shunt tube assemblies 28 described herein are merely one example of a wide variety of different ways in which a shunt flow path can be provided for a slurry in a well. It is not necessary for the shunt tube assemblies 28 to be constructed as depicted in the drawings, the shunt tube assemblies are not necessarily positioned between the outer shroud 30 and the filter 32 or base pipe 34, the nozzles 44 are not necessarily connected to one of two parallel tubes, the shunt flow path does not necessarily extend through tubes, etc. Thus, it will be appreciated that the scope of this disclosure is not limited to the details of the screen 24, shunt tube assemblies 28 or nozzles 44 as described herein or depicted in the drawings.

Figure 5:
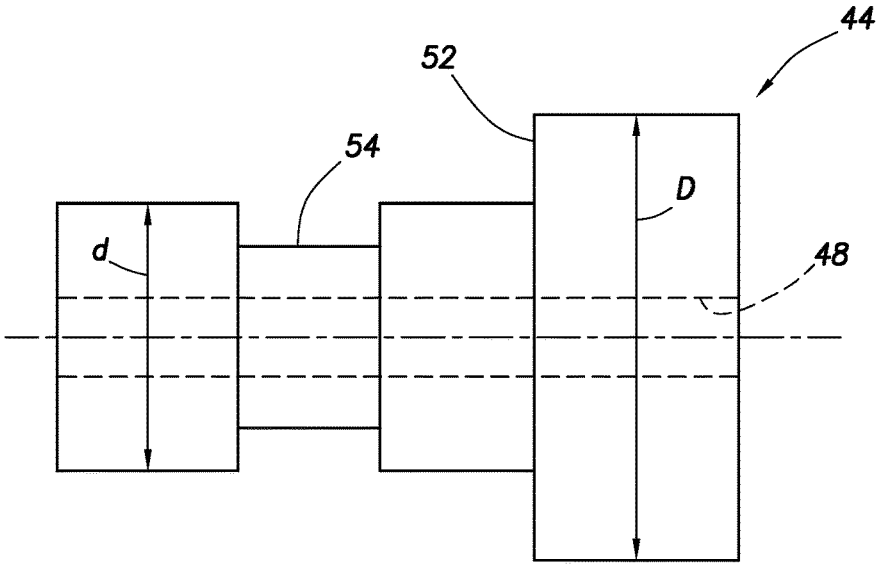
FIG. 5 is an enlarged scale representative elevational view of a nozzle which may be used in the shunt tube assembly.
Figure 6:
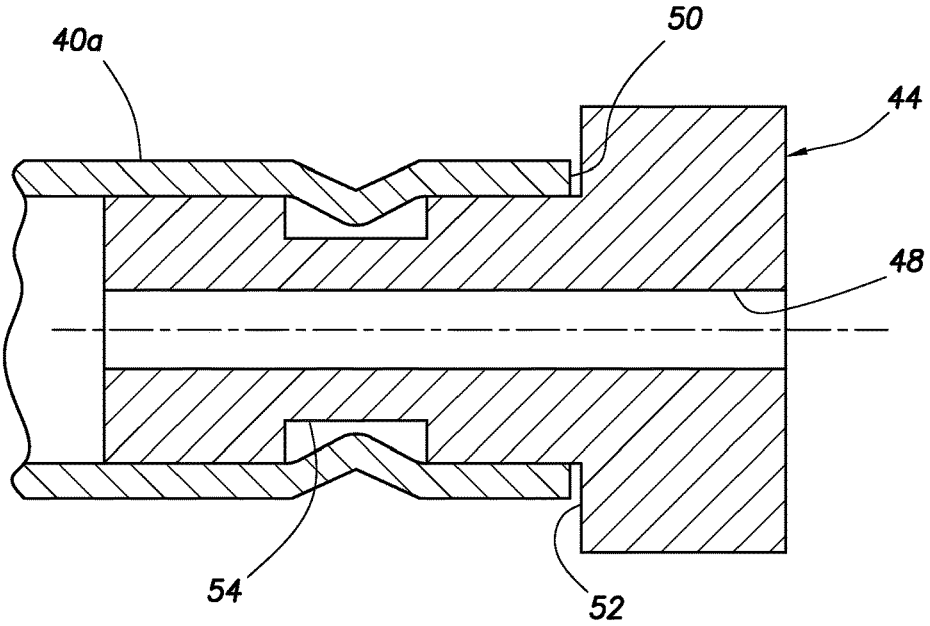
FIG. 6 is a representative cross-sectional view of the nozzle crimped in a tube of the shunt tube assembly.

Referring additionally now to FIGS. 5 & 6, an enlarged scale elevational and cross-sectional views of one example of the nozzle 44 is representatively illustrated, apart from the remainder of the shunt tube assembly 28. In this view, it may be seen that the nozzle 44 is designed to be conveniently attached to a branch slurry discharge tube 40*a* for delivering the slurry 22 to the annulus 20, and preventing voids therein.

The nozzle 44 is preferably made of an erosion resistant material (such as tungsten carbide), and has a reduced flow area passage 48 relative to an inner diameter of the tube 40*a*. This increases a velocity of the slurry 22 as it exits the nozzle 44, thereby "jetting" the slurry into the annulus 20 for enhanced prevention of voids.

The nozzle 44 includes a reduced outer diameter d which is preferably slightly larger than the inner diameter of the tube 40*a*, so that a slight interference fit is obtained when the nozzle is inserted into an end 50 of the tube 40*a*. In other examples, the nozzle 44 diameter d could be a slip fit into the tube 40*a*. For ease of insertion, the diameter d may be slightly tapered.

A shoulder 52 is formed between the reduced diameter d and a larger diameter D on the nozzle 44. This shoulder 52 serves as a "stop" to prevent further insertion of the nozzle 44 into the tube 40*a*.

With the end 50 of the tube 40*a* adjacent the shoulder 52, the nozzle 44 is properly positioned for crimping. At this point, the tube 40*a* can be crimped onto the nozzle 44 by deforming the tube into a recess 54 formed on the nozzle.

In this manner, the nozzle 44 is quickly, conveniently and securely attached to the tube 40*a*. The crimping process is more cost-effective than other techniques, such as threading, welding, brazing, etc.

The crimping may be performed using any conventional crimping tool capable of inwardly deforming the tube 40*a*. Alternatively, a specialized tool could be constructed for use with particular tube 40*a* and nozzle 44 dimensions.

A method of securing a nozzle 44 in an end 50 of a slurry discharge tube 40*a* is provided to the art by the above disclosure. In one example, the method can comprise inserting the nozzle 44 into the end 50 of the slurry discharge tube 40*a;* and crimping the slurry discharge tube 40*a* onto the nozzle 44.

The method can also include flowing a slurry 22 through the tube 40*a* and nozzle 44 into an annulus 20 surrounding a well screen 24.

The crimping can include deforming the tube 40*a* inwardly. The crimping can include deforming the tube 40*a* into a recess 54 formed on the nozzle 54.

The nozzle 44 may comprise a slurry discharge passage 48 having a flow area less than a flow area of the tube 40*a*.

The nozzle 44 is preferably made of an erosion resistant material. The nozzle 44 is preferably at least more erosion resistant than the tube 40*a*.

The nozzle 44 preferably increases a velocity of a slurry 22 flowed through the nozzle. The slurry 22 flows faster through the nozzle 44 as compared to the tube 40*a*.

A well screen shunt tube assembly 28 is also described above. In one example, the shunt tube assembly 28 can include a slurry discharge tube 40*a*, and a nozzle 44 inserted into an end 50 of the slurry discharge tube, the slurry discharge tube being crimped onto the nozzle.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of securing a nozzle in an end of a slurry discharge tube, the method comprising:

inserting the nozzle into the end of the slurry discharge tube with the end of the slurry discharge tube adjacent a shoulder of the nozzle, the shoulder being formed between a reduced outer diameter and a larger diameter of the nozzle so that an inlet end of the nozzle ends up inside the slurry discharge tube between an inlet and an outlet of the slurry discharge tube; and crimping the slurry discharge tube onto the nozzle with the inlet end of the nozzle inside the slurry discharge tube between the inlet and the outlet of the slurry discharge tube, wherein crimping includes deforming the slurry discharge tube into a recess formed on the nozzle in a portion of the nozzle having the reduced outer diameter, wherein the larger diameter of the shoulder is larger than an outermost diameter of the slurry discharge tube.

2. The method of claim 1, further comprising flowing a slurry through the tube and nozzle into an annulus surrounding a well screen.

3. The method of claim 1, wherein the nozzle comprises a slurry discharge passage having a flow area less than a flow area of the tube.

4. The method of claim 1, wherein the nozzle comprises erosion resistant material.

5. The method of claim 1, wherein the nozzle increases a velocity of a slurry flowed through the nozzle.

6. A well screen shunt tube assembly, comprising:

a slurry discharge tube; and a nozzle inserted into an end of the slurry discharge tube with an inlet end of the nozzle inside the slurry discharge tube between an inlet and an outlet of the slurry discharge tube, with an end of the slurry discharge tube adjacent a shoulder of the nozzle, the shoulder being formed between a reduced outer diameter and a larger diameter of the nozzle, the slurry discharge tube being crimped onto the nozzle, with a deformed portion of the slurry discharge tube extending into a recess formed on the nozzle in a portion of the nozzle having the reduced outer diameter, wherein the larger diameter of the shoulder is larger than an outermost diameter of the slurry discharge tube.

7. The well screen shunt tube assembly of claim 6, wherein the nozzle comprises a slurry discharge passage having a flow area less than a flow area of the tube.

8. The well screen shunt tube assembly of claim 6, wherein the nozzle comprises erosion resistant material.

9. The well screen shunt tube assembly of claim 6, wherein the nozzle increases a velocity of a slurry flowed through the nozzle.

* * * * *